US010381736B2

(12) United States Patent
Jung et al.

(10) Patent No.: US 10,381,736 B2
(45) Date of Patent: Aug. 13, 2019

(54) METHOD AND DEVICE FOR EXTENDING BEAM AREA IN WIRELESS COMMUNICATION SYSTEM

(71) Applicant: Samsung Electronics Co., Ltd., Suwon-si, Gyeonggi-do (KR)

(72) Inventors: Dong-Yun Jung, Anyang-si (KR); Sung-Tae Choi, Hwaseong-si (KR); Ji-Hoon Kim, Suwon-si (KR); Yi-Ju Roh, Suwon-si (KR); Yun-A Shim, Hoengseong-gun (KR); Dong-Hyun Lee, Anyang-si (KR); Seung-Pyo Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 15/121,213

(22) PCT Filed: Feb. 27, 2015

(86) PCT No.: PCT/KR2015/001939
§ 371 (c)(1),
(2) Date: Aug. 24, 2016

(87) PCT Pub. No.: WO2015/130132
PCT Pub. Date: Sep. 3, 2015

(65) Prior Publication Data

US 2017/0012359 A1 Jan. 12, 2017

(30) Foreign Application Priority Data

Feb. 28, 2014 (KR) ..... 10-2014-0024409

(51) Int. Cl.
*H01Q 9/16* (2006.01)
*H01Q 3/30* (2006.01)
(Continued)

(52) U.S. Cl.
CPC ..... *H01Q 9/16* (2013.01); *H01Q 1/241* (2013.01); *H01Q 3/30* (2013.01); *H01Q 21/065* (2013.01); *H01Q 21/28* (2013.01)

(58) Field of Classification Search
CPC .. H01Q 9/16; H01Q 1/24; H01Q 3/30; H01Q 21/06; H01Q 21/28
(Continued)

(56) References Cited

U.S. PATENT DOCUMENTS 4,696,017 A 9/1987 Masheff et al.
7,053,847 B2 5/2006 Chan et al.
(Continued)

FOREIGN PATENT DOCUMENTS

CN 1614907 A 5/2005
CN 101212084 A 7/2008
(Continued)

OTHER PUBLICATIONS

Wang et al.; "Beam Codebook Based Beamforming Protocol for Multi-GBPS Millimeter-Wave WPAN systems"; IEEE Journal on Selected Areas in Communication, vol. 27, No. 8, Oct. 2009.
(Continued)

*Primary Examiner* — Andrea Lindgren Baltzell
(74) *Attorney, Agent, or Firm* — Jefferson IP Law, LLP

(57) ABSTRACT

The present disclosure relates to a pre-5th-generation (5G) or 5G communication system to be provided for supporting higher data rates beyond 4th-generation (4G) communication system such as long term evolution (LTE). An electronic device is provided in a wireless communication system. The device comprises a plurality of antenna sets; a plurality of antenna elements configuring the plurality of antenna sets; an RF transceiver including a plurality of switches for selecting the plurality of antenna elements and a plurality of phase shifters for shifting the phase of a signal transmitted/
(Continued)

received through the plurality of antenna elements; and a control unit for determining a beam forming direction and the phase of the signal by simultaneously controlling the plurality of switches and the plurality of phase shifters according to a beambook.

19 Claims, 14 Drawing Sheets

(51) Int. Cl.
*H01Q 21/06* (2006.01)
*H01Q 21/28* (2006.01)
*H01Q 1/24* (2006.01)

(58) Field of Classification Search
USPC ..... 343/793
See application file for complete search history.

(56) References Cited

U.S. PATENT DOCUMENTS

| | | | |
|---|---|---|---|
| 7,280,848 | B2 | 10/2007 | Hoppenstein |
| 7,403,172 | B2 | 7/2008 | Cheng |
| 8,229,352 | B2 | 7/2012 | Doan et al. |
| 8,279,132 | B2 | 10/2012 | Jung et al. |
| 10,096,891 | B2 | 10/2018 | Choudhury et al. |
| 2005/0136857 | A1 | 6/2005 | Yamamoto et al. |
| 2008/0158054 | A1 | 7/2008 | Yong et al. |
| 2009/0231225 | A1* | 9/2009 | Choudhury ..... H01Q 3/26 343/770 |
| 2009/0323840 | A1 | 12/2009 | Lee et al. |
| 2010/0061482 | A1 | 3/2010 | Lee et al. |
| 2011/0014878 | A1 | 1/2011 | Choudhury et al. |
| 2013/0017836 | A1 | 1/2013 | Chang et al. |
| 2013/0050056 | A1 | 2/2013 | Lee et al. |
| 2013/0147664 | A1 | 6/2013 | Lin |
| 2013/0229307 | A1 | 9/2013 | Chang et al. |

FOREIGN PATENT DOCUMENTS

| | | | |
|---|---|---|---|
| CN | 101971519 | A | 2/2011 |
| CN | 102495565 | A | 6/2012 |
| EP | 2 253 076 | A2 | 11/2010 |
| KR | 10-2008-0086333 | A | 9/2008 |
| KR | 10-2009-0023364 | A | 3/2009 |
| KR | 10-2009-0075888 | A | 7/2009 |
| KR | 10-2011-0057630 | A | 6/2011 |
| KR | 10-2012-0098882 | A | 9/2012 |
| KR | 10-2013-0009314 | A | 1/2013 |
| WO | 2007/130027 | A1 | 11/2007 |
| WO | 2009/114486 | A2 | 9/2009 |
| WO | 2013/090456 | A1 | 6/2013 |

OTHER PUBLICATIONS

Chinese Office Action dated dated Oct. 8, 2018, issued in a counterpart Chinese application No. 201580010849.X.

Chinese Office Action dated May 27, 2019, issued Chinese Application No. 201580010849.

* cited by examiner

METHOD AND DEVICE FOR EXTENDING BEAM AREA IN WIRELESS COMMUNICATION SYSTEM

CROSS-REFERENCE TO RELATED APPLICATION(S)

This application is a U.S. National Stage application under 35 U.S.C. § 371 of an International application filed on Feb. 27, 2015 and assigned application number PCT/KR2015/001939, which claimed the benefit of a Korean patent application filed on Feb. 28, 2014 in the Korean Intellectual Property Office and assigned Serial number 10-2014-0024409, the entire disclosure of which is hereby incorporated by reference.

TECHNICAL FIELD

The present invention relates to a method and apparatus for beam coverage extension when wireless communication is performed by using a millimeter-wave band.

BACKGROUND ART

To meet the demand for wireless data traffic having increased since deployment of 4th generation (4G) communication systems, efforts have been made to develop an improved $5^{th}$ generation (5G) or pre-5G communication system. Therefore, the 5G or pre-5G communication system is also called a 'Beyond 4G Network' or a 'Post LTE System'.

The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems.

In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like.

In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

Communication may be interrupted by an obstacle in a millimeter-wave frequency band due to linearity of propagation. Therefore, a Line-Of-Sight (LOS) environment needs to be always maintained, or a beamforming function is necessarily required for smooth communication in a non-LOS environment. Further, beam coverage needs to be expanded in an antenna of the millimeter-wave band since the antenna has directivity instead of omni-directional radiation.

Therefore, there is a need for a low-power and small-size Radio Frequency (RF) transceiver including the beamforming function in the millimeter-wave frequency band.

DETAILED DESCRIPTION OF THE INVENTION

Technical Problem

Accordingly, an object of the present invention is to provide a method and apparatus for expanding beam coverage in a wireless communication system.

Another object of the present invention is to provide a method and apparatus for controlling a beamforming direction in a wireless communication system.

Another object of the present invention is to provide a method and apparatus for minimizing a signal loss when a beamforming direction is controlled in a wireless communication system.

Another object of the present invention is to provide a method and apparatus for simultaneously controlling a phase shifter and a switch for selecting an antenna element so as to overcome a unique propagation characteristic such as linearity, narrow beam coverage, or the like of a millimeter-wave and so as to expand beam coverage for allowing high-speed communication by using a millimeter-wave band.

Another object of the present invention is to provide a method and apparatus for decreasing a package size for a transceiver by using a direct conversion structure not requiring an Intermediate Frequency (IF) end and by implementing it in a form of a transceiver in which a transmitter and a receiver are integrated.

Technical Solution

An electronic device in a wireless communication system is provided. The device includes a plurality of antenna sets consisting of a combination of a plurality of antenna elements, a plurality of switches for selecting the plurality of antenna elements, a radio frequency (RF) transceiver including a plurality of phase shifters for shifting a phase of a signal transmitted/received through the plurality of antenna elements, and a controller for determining a beamforming direction and the phase of the signal by simultaneously controlling the plurality of switches and the plurality of phase shifters.

A method of operating an electronic device in a wireless communication system is provided. The method includes determining a beam training area, determining a beam index corresponding to the beam training area, determining a plurality of antenna elements and a plurality of phase shifters according to the determined beam index, and selecting a best beam by measuring quality of a beam based on a shifted phase and the determined antenna element.

In various exemplary embodiments, the method further includes, before determining the beam training area, measuring link quality, and examining whether the link quality satisfies a Quality of Service (QoS).

In various exemplary embodiments, the plurality of antenna sets and the plurality of antenna elements are integrated on a multi-layer substrate.

In various exemplary embodiments, the multi-layer substrate has sections A, B, and C configured in a row.

In various exemplary embodiments, the plurality of antenna sets and the plurality of antenna elements include at least one of a broadside antenna and an end-fire antenna.

In various exemplary embodiments, the plurality of antenna sets and the plurality of antenna elements include a plurality of broadside antennas.

In various exemplary embodiments, the plurality of antenna sets and the plurality of antenna elements include a plurality of end-fire antennas.

In various exemplary embodiments, the broadside antenna consists of at least one layer in the section A.

In various exemplary embodiments, the broadside antenna consists of at least one layer in the section B.

In various exemplary embodiments, the broadside antenna consists of at least one layer in the section C.

In various exemplary embodiments, the end-fire antenna is located in the section A.

In various exemplary embodiments, the end-fire antenna is located in the section B.

In various exemplary embodiments, the end-fire antenna is located in the section C.

In various exemplary embodiments, the beam book includes at least one of the beam index, switch information for the beam index, and phase information.

A wireless communication device is provided. The wireless communication device includes: at least two switches for selecting at least two of a plurality of antenna elements;

a plurality of phase shifters electrically coupled to the at least two switches to shift a phase of an RF signal; and a controller for controlling the two or more switches and the plurality of phase shifters according to a beamforming direction of the RF signal.

Advantageous Effects

The present invention simultaneously controls a phase shifter and a switch by using a beam book, thereby having an advantage in that a communication interruption and a signal loss can be decreased in a millimeter-wave band high-speed communication system.

MODE FOR CARRYING OUT THE INVENTION

Exemplary embodiments of the present invention will be described herein below with reference to the accompanying drawings. Further, in the following description of the present invention, well-known functions or constructions are not described in detail since they would obscure the invention in unnecessary detail. Also, the terms used herein are defined according to the functions of the present invention, and thus may vary depending on user's or operator's intention and usage. Therefore, the definition of the terms used herein must be understood based on the descriptions made herein.

Hereinafter, a method and apparatus for expanding beam coverage in a wireless communication system will be described.

The present invention relates to a technique for communicating large-volume data of at least several Gbps by using a millimeter-wave band. Communication may be interrupted by an obstacle in a millimeter-wave frequency band due to linearity of propagation. Therefore, a Line-Of-Sight (LOS) environment needs to be always maintained, or a beamforming function is necessarily required for smooth communication in a non-LOS environment. Further, beam coverage needs to be expanded in an antenna of the millimeter-wave band since the antenna has directivity instead of omni-directional radiation.

Accordingly, the present invention describes a method of overcoming linearity and narrow beam coverage as a unique propagation characteristic of a millimeter-wave, and a structure thereof.

Figure 1:
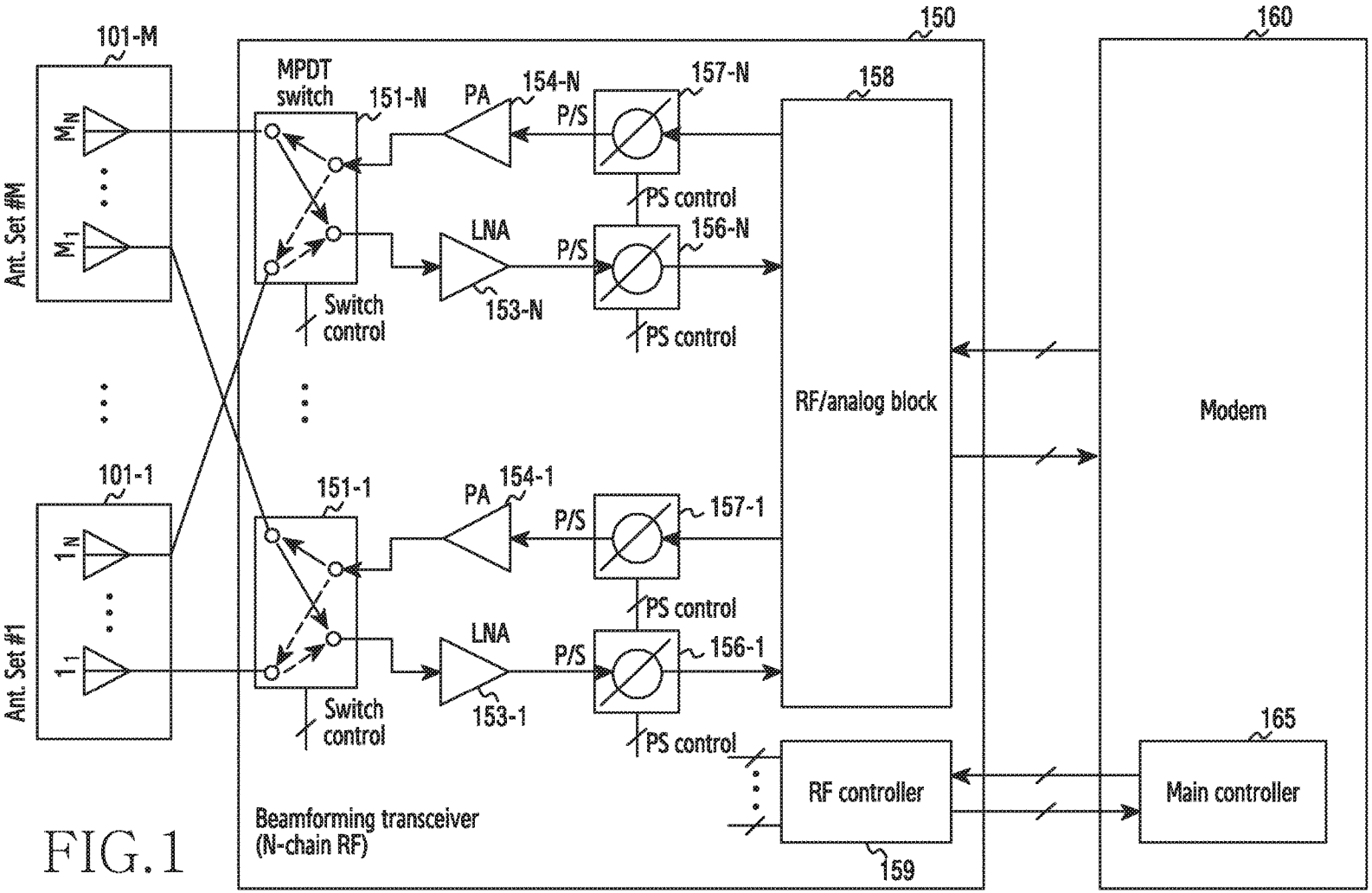
FIG. 1 is a block diagram of a Radio Frequency (RF) transceiver according to an exemplary embodiment of the present invention.

FIG. 1 is a block diagram of an RF transceiver according to an exemplary embodiment of the present invention.

Referring to FIG. 1, the RF transceiver of the present invention performs a beamforming function to overcome linearity of a millimeter-wave. The beamforming function including an RF phase shift function using an RF phase shifter may be implemented by using various methods such as a Local Oscillator (LO) phase shift method, an analog/baseband phase shift method, or the like. A controller controls the phase shifter to enable high speed beamforming.

For beam coverage expansion, the RF transceiver of the present invention consists of a plurality of M antenna sets 101-1 to 101-M. Each antenna set may have a structure of a broadside antenna or an end-fire antenna, and the two structures may be combined. The broadside antenna set may output a beam in an up or down direction with respect to a flat surface. The end-fire antenna set may output the beam in a north, south, east, or west direction with respect to the flat surface. The antenna set having the mixed structure of the broadside antenna and the end-fire antenna may form a beam in a different direction other than the up, down, north, south, east, and west directions with respect to the flat surface.

According to a switching operation of switches 151-1 to 151-N under the control of an RF controller 159, N antenna elements are selected from M×N antenna elements constituting the M antenna sets 101-1 to 101-M. Herein, the switches 151-1 to 151-N represent a Multi Pole Double Throw (MPDT) switch.

In this case, the RF controller 159 constitutes a beam book and thus simultaneously controls the switches 151-1 to 151-N for selecting the antenna element and phase shifters 156-1 to 156-N and 157-1 to 157-N for controlling an Antenna Weight Vector (AWV) to allow high-speed beamforming.

That is, the present invention can perform a beamforming function in which the RF controller 159 controls the phase shifters 156-1 to 156-N and 157-1 to 157-N to change a beam angle. The M antenna sets 101-1 to 101-M consisting of N elements are used to expand antenna beam coverage.

The M antenna sets 101-1 to 101-M consisting of the N antenna elements consist of M broadside antenna sets, M end-fire antenna sets, or M antenna sets in which the broadside antenna and the end-fie antenna are mixed.

The RF controller 159 uses the beam book to select N elements from M×N antenna elements by using a switch for selecting N antenna elements. In this case, Power Amplifiers (PAs) 154-1 to 154-N perform an amplification function for transmission, and Low Noise Amplifiers (LNAs) 153-1 to 153-N perform low-noise amplification for a reception signal. Further, an RF/analog block 158 may perform an analog-digital conversion process for a transmission/reception signal.

In addition, the RF controller 159 allows high-speed beam forming in such a manner that the switches 151-1 to 151-N for selecting the antenna elements and the phase shifters 156-1 to 156-N and 157-1 to 157-N for controlling an antenna weight vector are simultaneously controlled by using the beam book under the control of a main controller 165.

The main controller 165 may control the RF controller 159 to indicate whether to perform the beamforming function. Further, the main controller 165 may provide a beam index to the RF controller 159.

A modem 160 performs a conversion function between a baseband signal and a bit-stream according to a physical layer protocol of a system. For example, in data transmission, the modem 160 generates complex symbols by coding and modulating a transmission bit-stream. Further, in data reception, the modem 160 restores a reception bit-stream by demodulating and decoding the baseband signal provided from a beamforming transceiver 150.

The modem 160 and the beamforming transceiver 150 transmit and receive a signal as described above. Accordingly, the modem 160 and the beamforming transceiver 150 may be referred to as a transmitter, a receiver, a transceiver, or a communication unit. Further, the beam book is as shown in Table 1 below.

TABLE 1

| Beam Index | Switch control | | | | Phase shifter control | | | |
|---|---|---|---|---|---|---|---|---|
| 0 | SW[0] | SW[1] | . . . | SW[I] | PS[0] | PS[1] | . . . | PS[J] |
| 1 | SW[0] | SW[1] | . . . | SW[I] | PS[0] | PS[1] | . . . | PS[J] |
| Z | SW[0] | SW[1] | . . . | SW[I] | PS[0] | PS[1] | . . . | PS[J] |

In Table 1 above, the RF controller 159 controls a switch and a phase shifter for a determined beam direction according to the control and provided information of the main controller 165. That is, the main controller 165 determines the beam direction, and provides a beam index for the determined beam direction to the RF controller 159.

Thereafter, according to the beam index included in the beam book, the RF controller 159 turns the switch on, and regulates the phase shifter. In Table 1 above, SW[0], SW[1], . . . , SW[I] correspond to the number of bits of N switches. PS[0], PS[1], . . . , PS[J] denote the number of bits of N phase shifters, and indicate that the switch and the phase shifter are simultaneously controlled according to the beam index.

Figure 2:
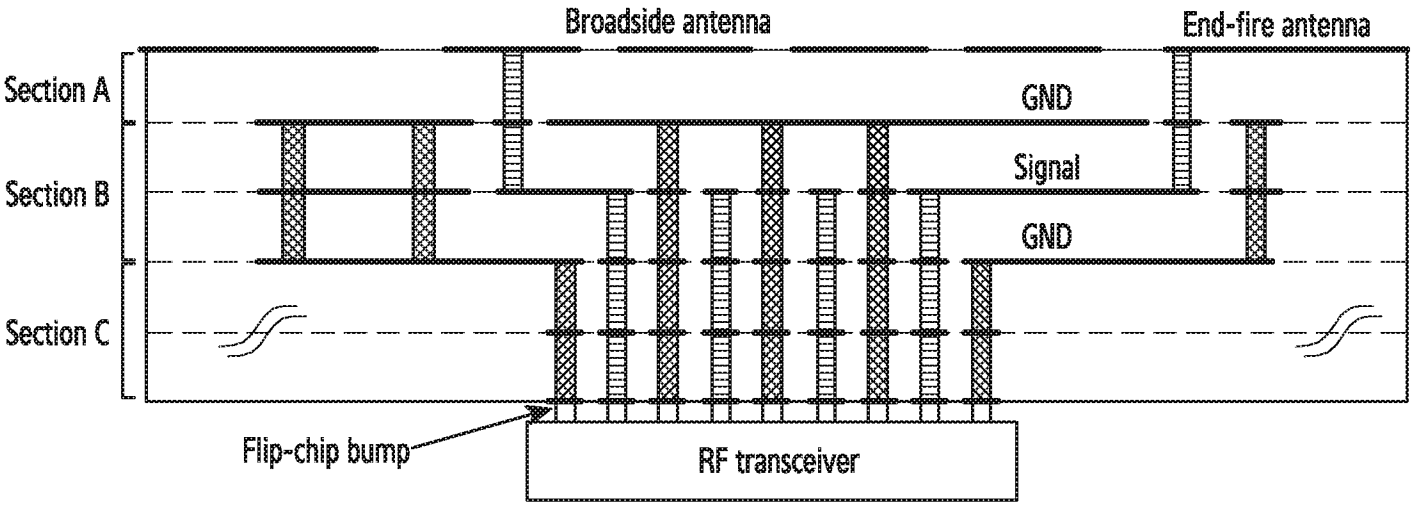
FIG. 2 is a first diagram illustrating a structure of an RF transceiver according to an exemplary embodiment of the present invention.

FIG. 2 is a first diagram illustrating a structure of an RF transceiver according to an exemplary embodiment of the present invention.

Referring to FIG. 2, a multi-layer substrate of the RF transceiver is divided into three sections, i.e., sections A, B, and C. For example, it is shown in FIG. 2 that an antenna set in which a broadside antenna and an end-fire antenna are mixed is located at a top plane of the section A.

An RF signal is delivered through an antenna, the RF transceiver, and a via and a signal line of the multi-layer substrate. Although the RF signal may be located in all of the sections A, B, and C, it is located at the section B for example in FIG. 2. Further, although the RF transceiver may be located at all of the sections A, B, and C, it is located at a bottom plane in the section C for example in FIG. 2. Each section may consist of at least one layer.

Figure 3:
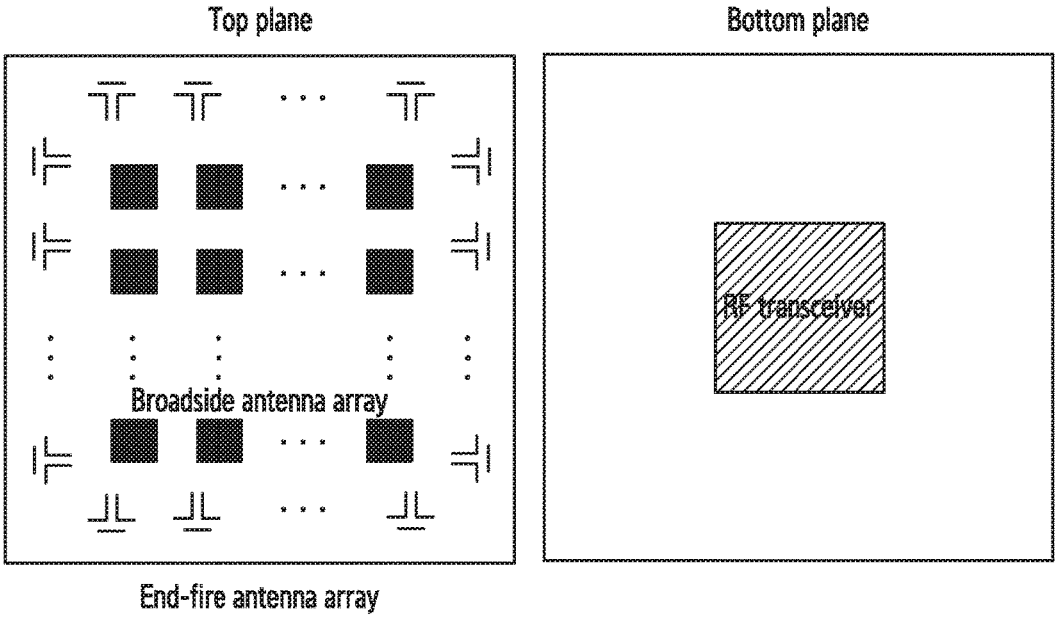
FIG. 3 is a second diagram illustrating a structure of an RF transceiver according to an exemplary embodiment of the present invention.

FIG. 3 is a second diagram illustrating a structure of an RF transceiver according to an exemplary embodiment of the present invention.

Referring to FIG. 3, the diagram of FIG. 2 is viewed from an upper portion and a lower portion. It is illustrated that a broadside antenna is directed to an upper portion and an end-fire antenna is directed to a lateral portion, and the RF transceiver is located at a lower portion of a multi-layer substrate. Each section may consist of at least one layer.

Figure 4:
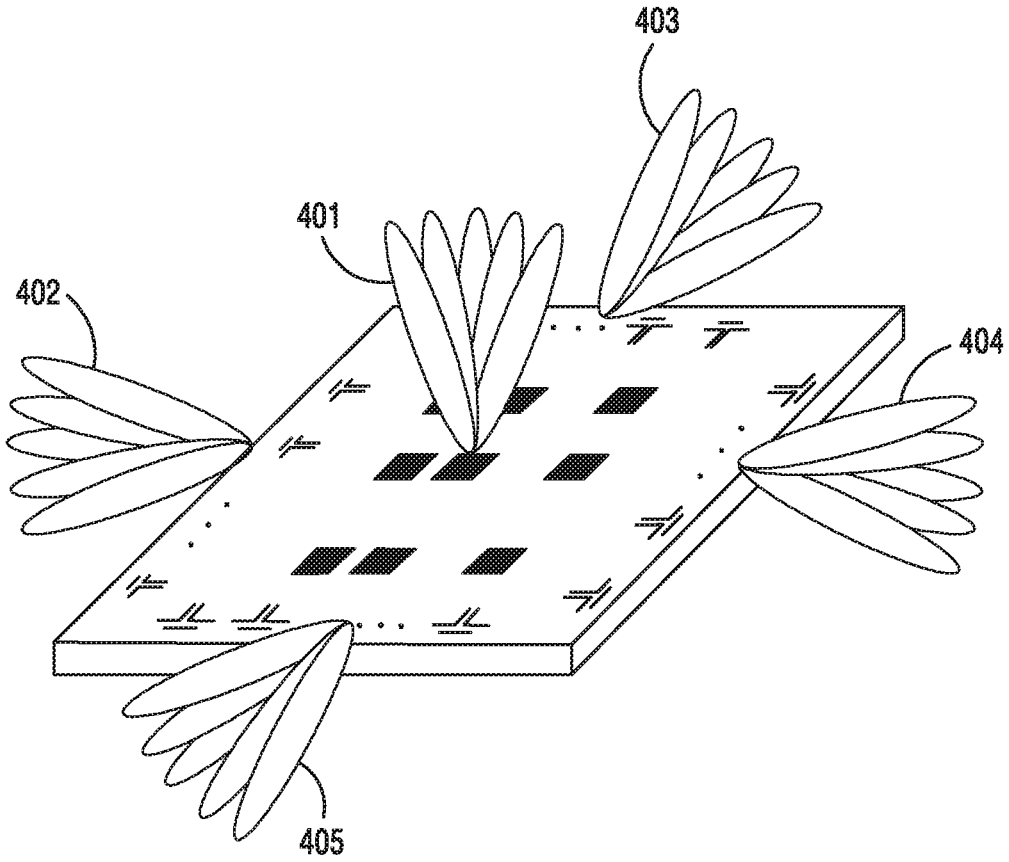
FIG. 4 is a third diagram illustrating a structure of an RF transceiver according to an exemplary embodiment of the present invention.

FIG. 4 is a third diagram illustrating a structure of an RF transceiver according to an exemplary embodiment of the present invention.

Referring to FIG. 4, among antennas, radiation directions of a broadside antenna and an end-fire antenna are illustrated.

The broadside antenna set radiates in an upper direction 401, and the end-fire antenna set radiates in lateral directions 402, 403, 404, and 405.

For example, in the present invention, N antenna elements located respectively in the directions 401, 402, 403, 404, and 405 indicate one antenna set among M antenna sets.

In implementations, RF signals radiated in the respective directions 401, 402, 403, 404, and 405 may be output as a vertical polarization or a horizontal polarization according to a wireless environment.

Figure 5:
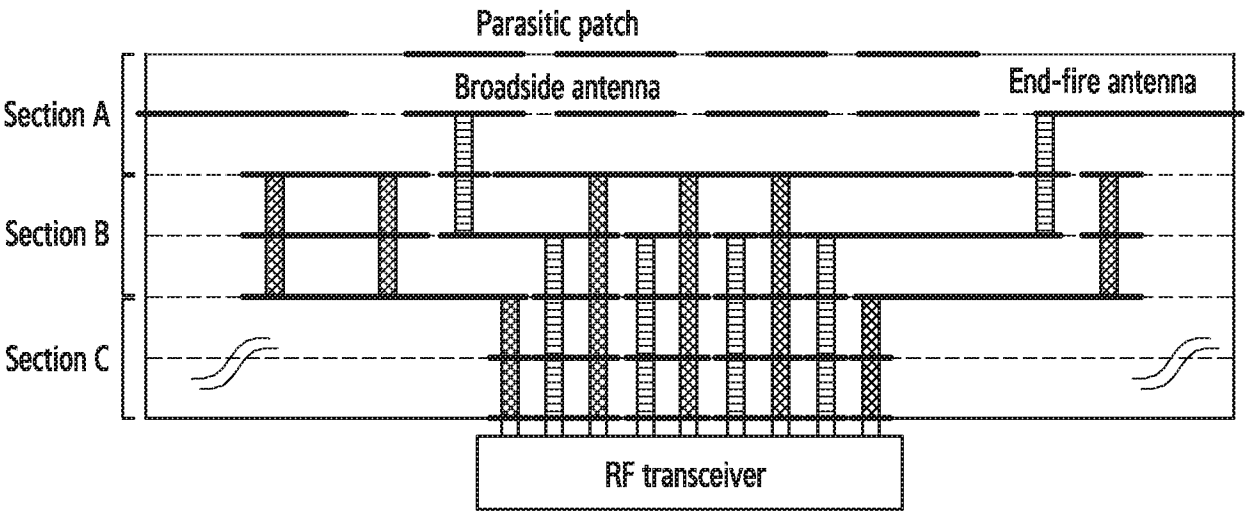
FIG. 5 is a fourth diagram illustrating a structure of an RF transceiver according to an exemplary embodiment of the present invention.

FIG. 5 is a fourth diagram illustrating a structure of an RF transceiver according to an exemplary embodiment of the present invention.

Referring to FIG. 5, it is illustrated that a broadside antenna is located in a section A as one or more layers, and an end-fire antenna is also located in the section A. In FIG. 5, a parasitic patch is located in a top plane of the section A. The broadside antenna and the end-fire antenna are both located in the section A. As described above, each section may consist of at least one layer.

Figure 6:
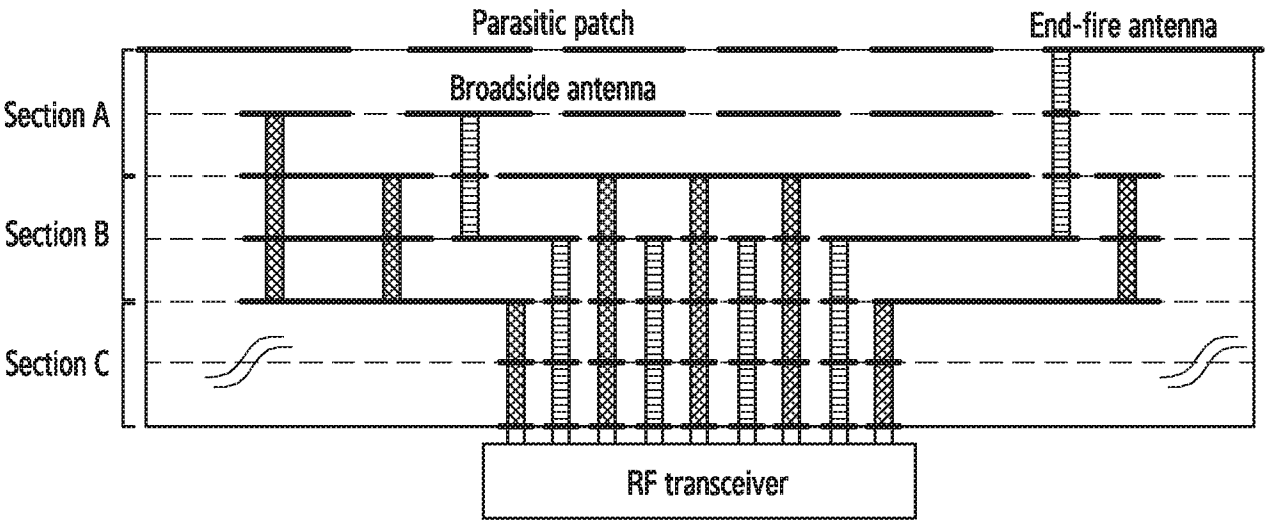
FIG. 6 is a fifth diagram illustrating a structure of an RF transceiver according to an exemplary embodiment of the present invention.

FIG. 6 is a fifth diagram illustrating a structure of an RF transceiver according to an exemplary embodiment of the present invention.

Referring to FIG. 6, it is illustrated that a broadside antenna is located in a section A as one or more layers, and an end-fire antenna is located in a top plane of the section A.

The broadside antenna and the end-fire antenna are both located in the section A, and a parasitic patch is located in the top plane of the section A. As described above, each section may consist of at least one layer.

Figure 7:
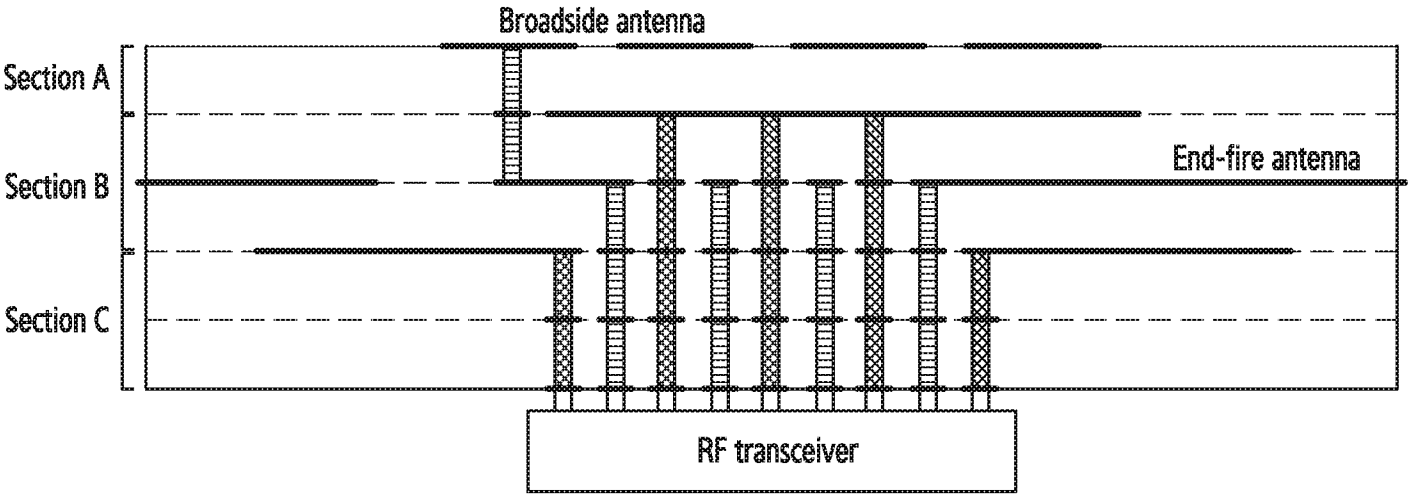
FIG. 7 is a sixth diagram illustrating a structure of an RF transceiver according to an exemplary embodiment of the present invention.

FIG. 7 is a sixth diagram illustrating a structure of an RF transceiver according to an exemplary embodiment of the present invention.

Referring to FIG. 7, it is illustrated that a broadside antenna is located in a top plane of a section A, and an end-fire antenna is located in a section B. As described above, each section may consist of at least one layer.

Figure 8:
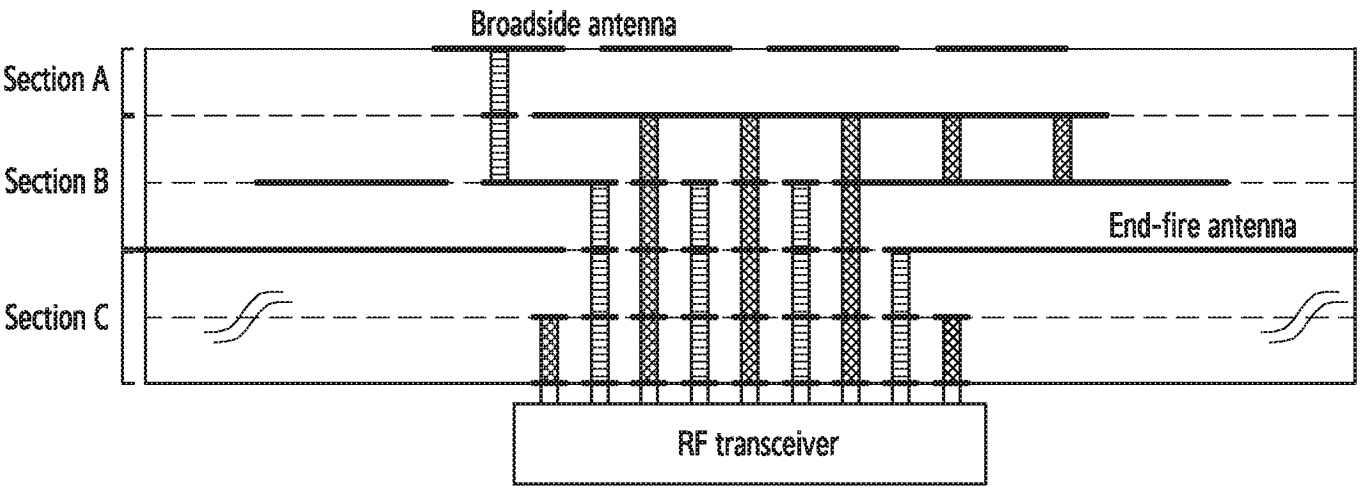
FIG. 8 is a seventh diagram illustrating a structure of an RF transceiver according to an exemplary embodiment of the present invention.

FIG. 8 is a seventh diagram illustrating a structure of an RF transceiver according to an exemplary embodiment of the present invention.

Referring to FIG. 8, it is illustrated that a broadside antenna is located in a section A, and an end-fire antenna is located in a top plane of a section C for example although it can be located in any layer in the section C consisting of at least one layer. As described above, each section may consist of at least one layer.

Figure 9:
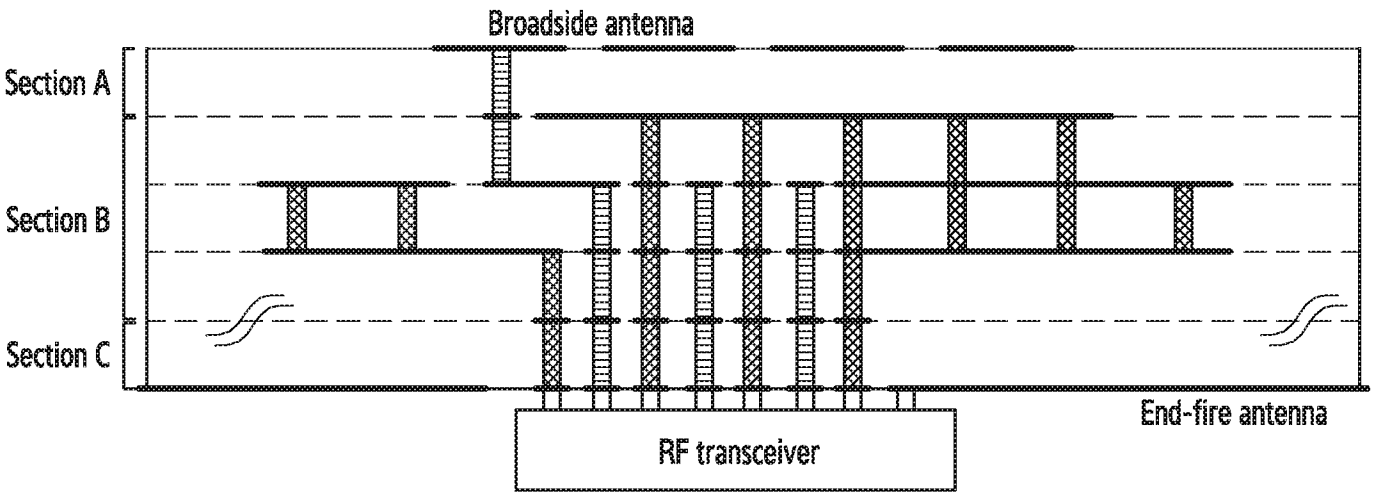
FIG. 9 is en eighth diagram illustrating a structure of an RF transceiver according to an exemplary embodiment of the present invention.

FIG. 9 is an eighth diagram illustrating a structure of an RF transceiver according to an exemplary embodiment of the present invention.

Referring to FIG. 9, it is illustrated that a broadside antenna is located in a top plane of a section A, and an end-fire antenna is located in a bottom plane of a section C for example although it can be located in any layer in the section C consisting of at least one layer. As described above, each section may consist of at least one layer.

Figure 10:
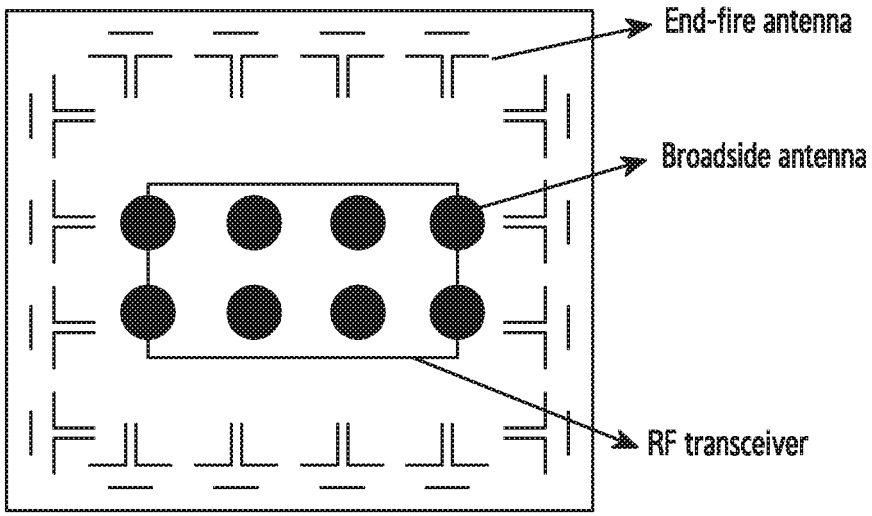
FIG. 10 is a ninth diagram illustrating a structure of an RF transceiver according to an exemplary embodiment of the present invention.

FIG. 10 is a ninth diagram illustrating a structure of an RF transceiver according to an exemplary embodiment of the present invention.

Referring to FIG. 10, it is illustrated a structure in which a broadside antenna and an end-fire antenna are mixed. Two types of antennas may be located in three sections such as sections A, B, and C of a multi-layer substrate. As described above, each section may consist of at least one layer.

Figure 11:
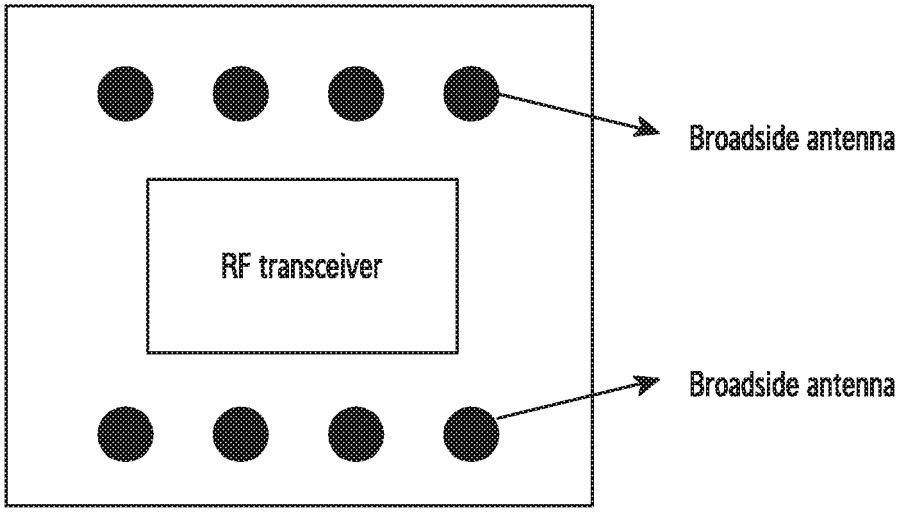
FIG. 11 is a tenth diagram illustrating a structure of an RF transceiver according to an exemplary embodiment of the present invention.

FIG. 11 is a tenth diagram illustrating a structure of an RF transceiver according to an exemplary embodiment of the present invention.

Referring to FIG. 11, it is illustrated a case of consisting of only a broadside antenna. The broadside antenna may be located in any sections such as sections A, B, and C. As described above, each section may consist of at least one layer.

Figure 12:
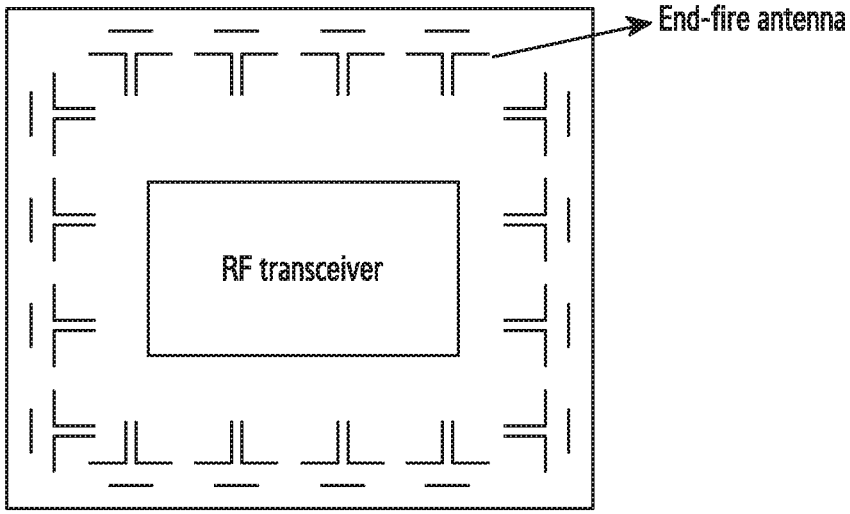
FIG. 12 is an eleventh diagram illustrating a structure of an RF transceiver according to an exemplary embodiment of the present invention.

FIG. 12 is an eleventh diagram illustrating a structure of an RF transceiver according to an exemplary embodiment of the present invention.

Referring to FIG. 12, it is illustrated a case where an antenna set consists of only an end-fire antenna. The end-fire antenna may be located in any section such as sections A, B, and C. As described above, each section may consist of at least one layer.

Figure 13:
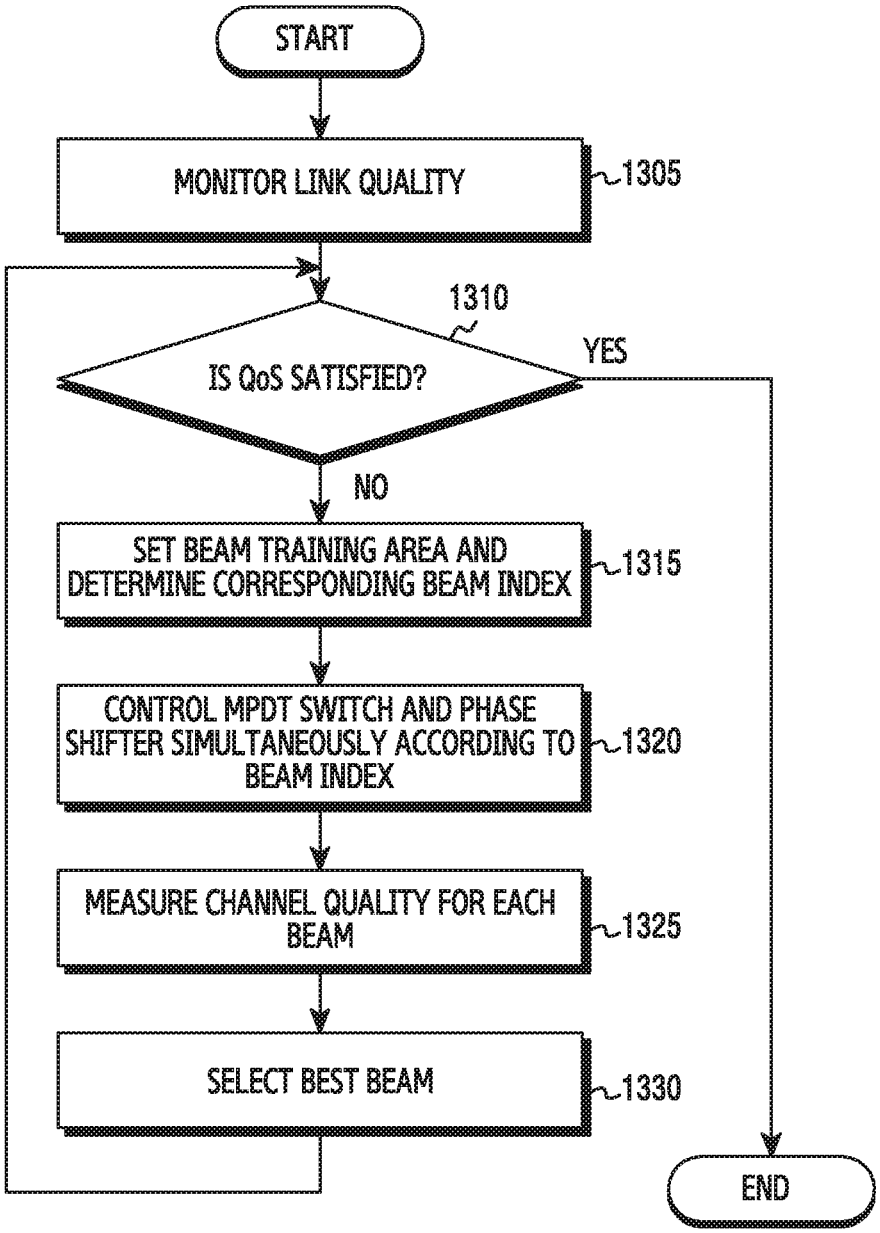
FIG. 13 is a flowchart illustrating a process of operating an RF transceiver according to an exemplary embodiment of the present invention.

FIG. 13 is a flowchart illustrating a process of operating an RF transceiver according to an exemplary embodiment of the present invention.

Referring to FIG. 13, the main controller 165 of the modem of the present invention or a beam management program 1414 to be described below monitors current uplink and/or downlink quality (step 1305).

Thereafter, the main controller 165 or the beam management program 1414 examines whether the monitored uplink or downlink quality satisfies a pre-set Quality of Service (QoS) (step 1310).

If the monitored uplink or downlink quality satisfies the pre-set QoS, the main controller 165 or the beam management program 1414 ends an algorithm of the present invention.

If the monitored uplink or downlink quality does not satisfy the pre-set QoS, the main controller 165 or the beam management program 1411 sets a beam training area and determines a beam index for the set beam training area (step 1315).

Thereafter, the main controller 165 or the beam management program 1414 provides the beam index to the RF controller 159 of the beamforming transceiver so that a phase shifter and an MPDT switch for selecting an antenna element can be simultaneously controlled (step S1320).

The RF controller 159 controls the beamforming switch and the phase shifter according to the beam index so that the electronic device can transmit or receive a beam by selecting an antenna set and a phase according to the determined beamforming direction (step 1325).

Thereafter, the controller 165 or the beam management program 1414 measures channel quality for the received beam, and selects a best beam (step 1330).

Thereafter, the main controller 165 or the beam management program 1414 examines whether the selected best beam satisfies the QoS (step 1310), and repeats the subsequent operations.

Figure 14:
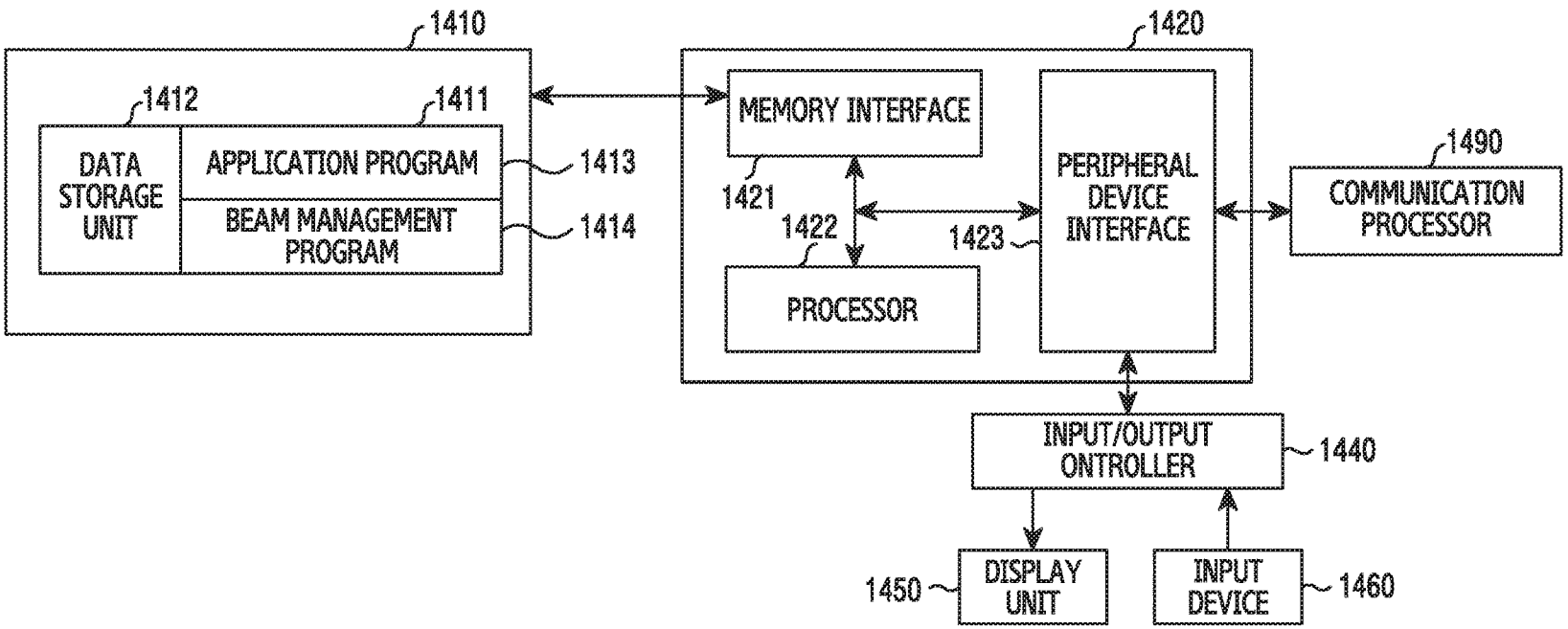
FIG. 14 is a block diagram of an electronic device according to an exemplary embodiment of the present invention.

FIG. 14 is a block diagram of an electronic device according to an exemplary embodiment of the present invention.

Referring to FIG. 14, the electronic device includes a memory 1410, a processor unit 1420, an input/output controller 1440, a display unit 1450, and an input device 1460. Herein, the memory 1410 may be plural in number. Each constitutional element is described as follows.

The memory 1410 includes a program storage unit 1411 for storing a program for controlling an operation of the electronic device and a data storage unit 1412 for storing data generated while the program is executed.

The data storage unit 1412 may store data required for operations of an application program 1413 and a beam management program 1414. In particular, the data storage unit 1412 may store a beam book according to the present invention.

The program storage unit 1411 includes the application program 1413 and the beam management program 1414. Herein, a program included in the program storage unit 1411 is a set of instructions and may be expressed as an instruction set.

The application program 1413 includes an application program which operates in the electronic device. That is, the application program 1413 includes an instruction of an application which is driven by the processor 1422.

The beam management program 1414 performs the aforementioned procedure of FIG. 13.

That is, the beam management program 1411 monitors current uplink and/or downlink quality, and examines whether the monitored uplink or downlink quality satisfies a pre-set Quality of Service (QoS).

If the monitored uplink or downlink quality does not satisfy the pre-set QoS, the beam management program 1411 sets a beam training area and determines a beam index for the set beam training area.

According to the determined beam index, the beam management program 1414 provides the beam index to the RF controller 159 of the beamforming transceiver so that a phase shifter and an MPDT switch for selecting an antenna element can be simultaneously controlled.

The beam management program 1414 measures channel quality for each beam, and selects a best beam.

The beam management program 1414 examines whether the selected best beam satisfies the QoS, and repeats the subsequent operations.

A memory interface 1421 controls an access to the memory 1410 of a component such as a processor 1422 or a peripheral device interface 1423.

The peripheral device interface 1423 controls a connection of the processor 1422 and the memory interface 1421 with respect to an input/output peripheral device of a base station.

The processor 1422 controls the base station to provide a corresponding service by using at least one software program. In this case, the processor 1422 executes at least one program stored in the memory 1410 and provides a service according to the program.

The input/output controller 1440 provides an interface between the peripheral device interface 1423 and an input/output device such as the display unit 1450 and the input device 1460.

The display unit 1450 displays state information, an input text, a moving picture, a still picture, or the like. For example, the display unit 1450 displays information of an application program driven by the processor 1422.

The input device 1460 provides input data generated by a selection of the electronic device to the processor unit 1420 through the input/output controller 1440. In this case, the input device 1460 includes a keypad including at least one hardware button, a touch pad for detecting touch information, or the like. For example, the input device 1460 provides touch information such as a touch, a movement of the touch, a release of the touch, or the like detected through the touch pad to the processor 1422 through the input/output controller 1440.

The electronic device includes a communication processor 1490 for performing a communication function for voice communication and data communication, and the communication processor 1490 includes the aforementioned beamforming transceiver 150 and modem 160 of FIG. 1.

While various embodiments have been shown and described with reference to certain preferred embodiments thereof, it will be understood by those skilled in the art that various changes in form and details may be made therein without departing from the spirit and scope of the invention as defined by the appended claims. Therefore, the scope of the various embodiments is defined not by the detailed description of the invention but by the appended claims, and all differences within the scope will be construed as being included in the present invention.

The invention claimed is:

1. An electronic device in a wireless communication system, the device comprising:

a plurality of antenna sets consisting of a combination of a plurality of antenna elements;

a radio frequency (RF) transceiver comprising a plurality of phase shifters configured to shift a phase of a signal transmitted/received through the plurality of antenna elements, and a plurality of switches configured to select the plurality of antenna elements;

a memory configured to store information on mapping of a plurality of beam indices corresponding to a plurality of beamforming directions, the plurality of switches and the plurality of phase shifters; and a main controller configured to:

determine a beamforming direction from among the plurality of beamforming directions, and transmit, to the RF transceiver, a beam index corresponding to the determined beamforming direction from among the plurality of beam indices, wherein the RF transceiver is configured to:

receive, from the main controller, the beam index, and control the plurality of switches and the plurality of phase shifters simultaneously according to the determined beam index using the information.

2. The device of claim 1, wherein the plurality of antenna sets and the plurality of antenna elements are integrated on a multi-layer substrate.

3. The device of claim 2, wherein the multi-layer substrate has sections A, B, and C configured in a row.

4. The device of claim 3, wherein the plurality of antenna sets and the plurality of antenna elements comprise at least one of a broadside antenna and an end-fire antenna.

5. The device of claim 3, wherein the plurality of antenna sets and the plurality of antenna elements comprise a plurality of broadside antennas.

6. The device of claim 3, wherein the plurality of antenna sets and the plurality of antenna elements comprise a plurality of end-fire antennas.

7. The device of claim 4, wherein the broadside antenna consists of at least one layer in the section A.

8. The device of claim 4, wherein the broadside antenna consists of at least one layer in the section B.

9. The device of claim 4, wherein the broadside antenna consists of at least one layer in the section C.

10. The device of claim 4, wherein the end-fire antenna is located in the section A.

11. The device of claim 4, wherein the end-fire antenna is located in the section B.

12. The device of claim 4, wherein the end-fire antenna is located in the section C.

13. A method of operating the electronic device according to claim 1 in a wireless communication system, the method comprising:

determining a beam training area;

determining a beam index corresponding to the beam training area;

determining a plurality of antenna elements and a plurality of phase shifters according to the determined beam index; and selecting a beam by measuring a quality of a beam.

14. The method of claim 13, further comprising:

before determining the beam training area;

measuring link quality, and examining whether the link quality satisfies a quality of service (QoS).

15. The method of claim 13, wherein the plurality of antenna elements are integrated on a multi-layer substrate.

16. The method of claim 15, wherein the multi-layer substrate has sections A, B, and C configured in a row.

17. The method of claim 16, wherein the plurality of antenna elements comprise at least one of a broadside antenna and an end-fire antenna.

18. The method of claim 16, wherein the plurality of antenna elements comprise a plurality of broadside antennas.

19. The method of claim 16, wherein the plurality of antenna elements comprise a plurality of end-fire antennas.

* * * * *